US005447303A

United States Patent [19]

Smith

[11] Patent Number: 5,447,303

[45] Date of Patent: Sep. 5, 1995

[54] SHEET INVERTER APPARATUS

[75] Inventor: Richard E. Smith, Fairport, N.Y.

[73] Assignee: Xerox Corporation, Stamford, Conn.

[21] Appl. No.: 262,717

[22] Filed: Jun. 20, 1994

[51] Int. Cl.[6] ..... B65H 39/10

[52] U.S. Cl. ..... 271/291; 271/65; 271/186; 271/187; 271/197; 271/902; 271/202

[58] Field of Search ..... 271/65, 186, 187, 197, 271/202, 303, 902, 291, 225

[56] References Cited

U.S. PATENT DOCUMENTS

| | | | |
|---|---|---|---|
| 3,227,444 | 1/1966 | Egan | 271/65 |
| 4,285,507 | 8/1981 | Marinoff | 271/197 X |
| 4,359,217 | 11/1982 | Roller et al. | 271/186 |
| 4,736,941 | 4/1988 | Petersen | 271/186 X |
| 5,028,045 | 7/1991 | Muller | 271/187 X |
| 5,261,655 | 11/1993 | Keller et al. | 271/187 |

*Primary Examiner*—H. Grant Skaggs
*Assistant Examiner*—Carol L. Druzbick

[57] ABSTRACT

An inverter for turning a sheet over and reversing the lead and trail edges of the sheet includes a disc stacker that works in conjunction with a vacuum transport. A sheet transported from a source is captured lead edge first by fingers or in a slot of the disc stacker which is rotating in a first direction. A vacuum transport is positioned adjacent the disc stacker and draws the sheet away from the disc stacker at a predetermined point and transports the sheet in a second direction opposite to the first direction trail edge first for further processing.

14 Claims, 2 Drawing Sheets

SHEET INVERTER APPARATUS

BACKGROUND OF THE INVENTION

This invention relates to an apparatus for turning sheets over, and more particularly, to an improved sheet inverting inverter apparatus that combines a disc stacker with a vacuum transport.

Although, a sheet inverter is referred to in the copier/printer art as an "inverter", its function is not necessarily to immediately turn the sheet over (i.e., exchange one face for the other). Its function is to effectively reverse the sheet orientation in its direction of motion. That is, to reverse the lead and trail edge orientation of the sheet. Typically, in inverters as disclosed here, the sheet is driven or fed by feed rollers or other suitable sheet driving mechanisms into a sheet reversing chute. By then reversing the motion of the sheet within the chute and feeding it back out from the chute, the desired reversal of the leading and trailing edges of the sheet in the sheet path is accomplished. Depending on the location and orientation of the inverter in a particular sheet path, this may, or may not, also accomplish the inversion (turning over) of the sheet in some applications, for example, where the "inverter" is located at the corner of a 90° to 180° inherent bend in the copy sheet path, the inverter may be used to actually prevent inverting of a sheet at that point, i.e., to maintain the same side of the sheet face-up before and after this bend in the sheet path. On the other hand, if the entering and departing path of the sheet, to and from the inverter, is in substantially the same plane, the sheet will be inverted by the inverter. Thus, inverters have numerous applications in the handling of either original documents or copy sheets to either maintain, or change, the sheet orientation.

In the field of reprographic machines, it is often necessary to feed along one of two alternate paths a copy sheet leaving the processor of the machine, particularly when the machine can selectively produce simplex (one-sided) and duplex (two-sided) sheets. Simplex sheets may be fed directly to an output tray, whereas the duplex sheets may pass to a sheet feeder which automatically reverses the direction of movement of a simplex sheet and feed it back into the processor, but inverted, so that the appropriate data can be applied to the second side of the sheet. One known sheet-feeder (U.S. Pat. No. 4,359,217) for effecting this includes three rollers in frictional or geared contact with each other, to provide two spaced-apart nips, one being an input nip to an associated downstream sheet pocket, and the other being an output nip for extracting each sheet from the pocket. A reversal unit for a document copying apparatus is shown in U.S. Pat. No. 3,227,444 in which documents to be copied are placed on a feed table and individually fed from the table to a rotating drum. The documents moves through a recording station where the obverse side, i.e. the side away from the drum is recorded. After the document is discharged from the drum it is either directed to a receiving hopper or to a reversal unit that includes a reversibly driven belt conveyor. Documents received on the belt conveyor are subsequently driven off the belt conveyor with the trail edge of the documents becoming the leading edges.

The present invention aims at providing an inverter designed to have a sheet to be duplexed fed to it, stored momentarily, and fed back to a processor for imaging onto the opposite side. The inverter includes a transport mechanism that combines a disk stacker and a vacuum-belt transport which accommodates various size sheets and allows the same or different exit nip speeds.

SUMMARY OF THE INVENTION

Accordingly, the present invention provides an inverter configuration that enables duplex in copier/-printers by combining a disc stacker with a vacuum transport to create a system for inverting a copy sheet and conveying it through an exit nip at the same speed or greater speed than which it was received. Varying degrees of sheet overlap can be accommodated on the vacuum transport which allows flexibility in controlling intercopy gap.

BRIEF DESCRIPTION OF THE DRAWINGS

The foregoing and other features of the instant invention will be apparent from a further reading of the specification, claims and from the drawings in which:

Figure 1:
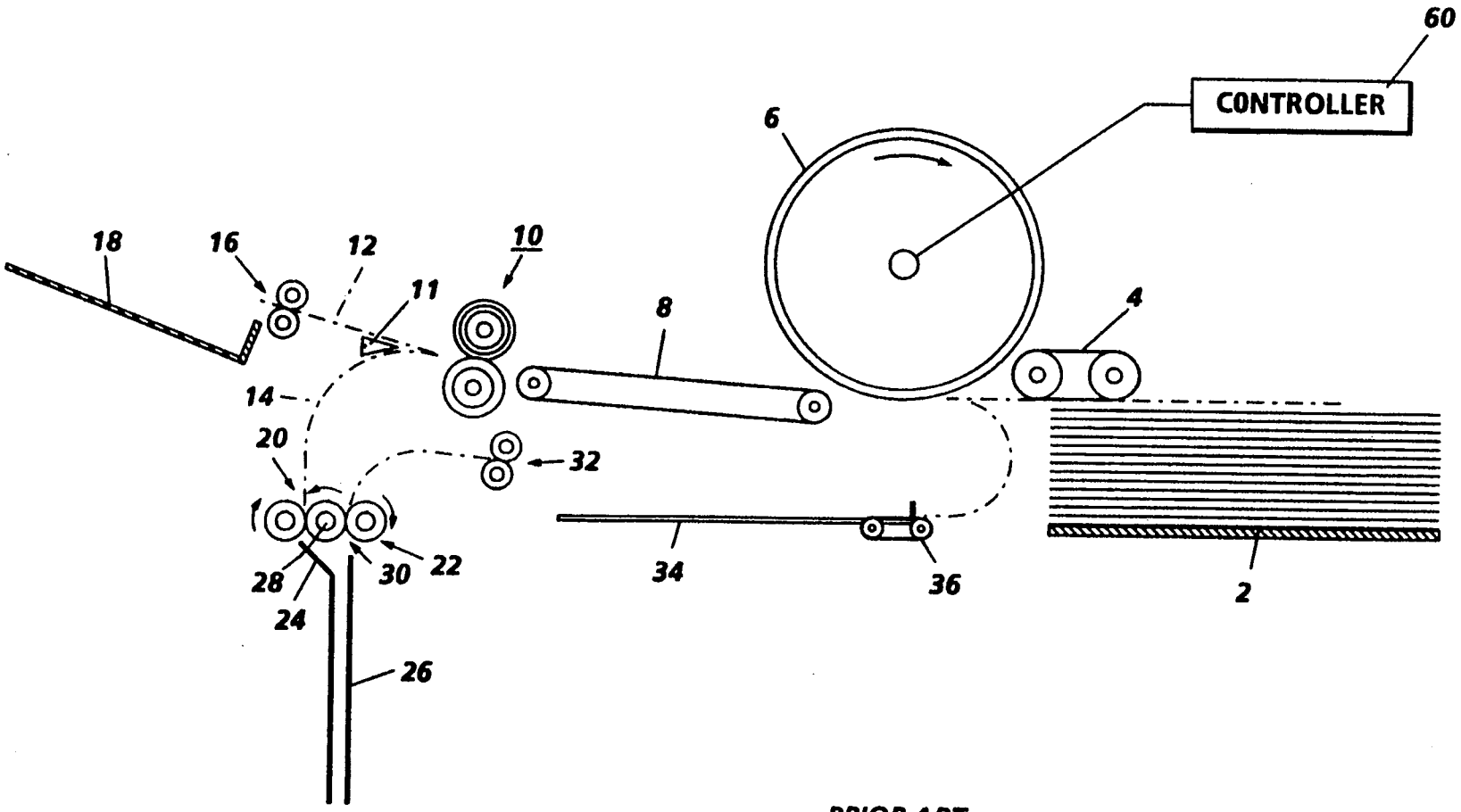
PRIOR ART FIG. 1
FIG. 1 is a schematic of a printing apparatus employing a conventional inverter.

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the inverter system of the present invention for a copier/printer. However, it should be understood that the sheet inverting method and apparatus of the present invention could be used with any machine in which inversion of a sheet is desired, be that sheet stacking or duplexing.

In general, an improvement to prior sheet inverter systems of machines is disclosed which is cost effective and comprises the use of a disc stacker with a vacuum transport in inverting sheets.

The known apparatus shown in FIG. I consists basically of means for holding a stack 2 of copy sheets adjacent to a feeder 4 for extracting a sheet from the top of the stack each time a copy is required. Each sheet leaving feeder 4 passes in non-sliding contact with a photoreceptor 6 (shown here in the form of a drum, although it could equally be a belt), from which a particulate material (toner) designed to present a visual contrast with the material of the sheet is transferred from the surface of the photoreceptor to the upper face of the respective sheet. After the sheet with the toner image held on it by electrostatic attraction has been detached from the photoreceptor 6, it is conveyed by a conveyor 8 to a fuser 10, which fuses the toner into a permanent bond with the material forming the sheet, by the application of heat and/or pressure.

On leaving the fuser, the sheet contacts a diverter 11 which deflects the sheet so that it moves along one of two paths 12 and 14. Path 12 is an output path, which leads to a sheet conveying nip 16 which ejects each finished sheet into an output tray 18. A sheet deflected along path 14 passes to the input nip 20 of tri-roll inverter generally referenced 22. Downstream of nip 20 is an inclined surface 24 leading to a substantially-vertical pocket 26. Although not shown in FIG. 1, the bottom of the pocket has in it known means, such as an aligned series of O-rings, positioned at a distance from the inverter 22 such that when the lead edge of the sheet being fed by nip 20 comes into contact with the O-rings etc., the trail edge of the sheet leaves the nip 20. Because of the lateral displacement (as viewed) of the pocket from the nip 20, the sheet being fed into the pocket necessarily has a curve induced in it. The natural resilience of the sheet material is used to flip the freed trail edge of the sheet to the right as viewed, immediately it is clear of the nip 20. The sheet itself has sufficient momentum to deflect the reversing means sufficiently to permit the trail edge of the sheet to move below the bottom of the center roll 28. When the energy stored in the distorted reversing means is released, it is expended on reversing the direction of the momentum of the sheet, and force the former trail edge of the sheet to become a new lead edge, which is forced into the other nip 30 of the inverter 22. The nip thus functions to extract the sheet from the pocket 26, and pass it through a sheet transport nip 32 into a buffer tray 34, which is sometimes also known as a dedicated duplex tray. With orientation as viewed, it will be seen that the face of the sheet having the first copy applied to it will be uppermost in tray 34. Each sheet in tray 34 is engaged by a bottom mounted feeder 36 which is effective to extract the sheet from the tray 34 and turn it through a sufficient angle for its remaining blank side to come into contact with the photoreceptor 6, and for the process to be repeated. Matters are arranged that when the resultant duplex copy sheet leaves fuser 10, it is passed directly to output tray 18, without being redirected towards inverter 22.

Figure 2:
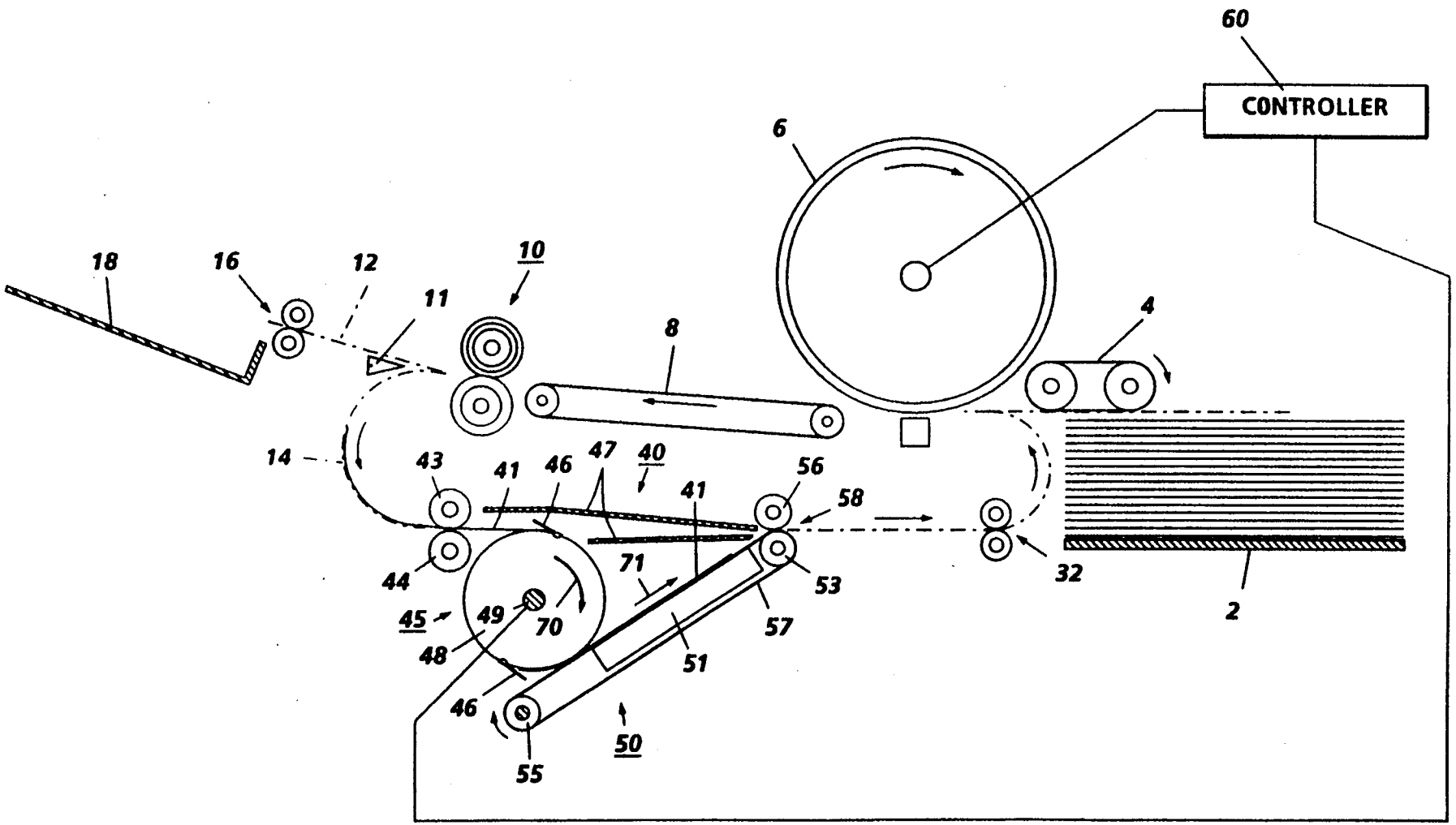
FIG. 2 is a schematic of the printing apparatus of FIG. 1 incorporating the inverter apparatus of the present invention therein.

With the inverter apparatus 40 of the present invention, as shown in FIG. 2, replacing the inverter 20 of FIG. 1, buffer tray 34 is preferably eliminated. This is called trayless duplex, but the sheets could all be deposited back into buffer tray 34 for subsequent feeding, if desired. Inverter 40 comprises an idler roll 43 that forms a sheet driving nip with drive roll 44. A rotating disc stacker 45 is mounted on shaft 49 for rotation in the direction of arrow 70. Fingers 46 are attached to the inverting roller 45 and in an initial or home position has one of the fingers facing the nip formed between an idler roller 43 and a drive roller 44 which drives a copy sheet into the fingers. Slots could be cut into the disc for use instead of fingers, if desired. Disc stacker 45 is connected to the machine controller 60 and adapted to be positioned by the controller 60 with the fingers intercepting individual sheets 41 at the 12 o'clock position when duplex printing is selected by a machine operator. A vacuum transport 50 is positioned adjacent disc stacker 45 at approximately the 6 o'clock position and adapted to attract sheets as they fall away from the surface of the disc stacker and fingers 46 due to centrifugal force as the disc stacker is rotated in the direction of arrow 70. Vacuum transport 50 conveys the sheets through nip 58 en route to nips 32 which take the sheets back past photoreceptor 6 for the deposit of an image onto the back or second side of the sheets. Vacuum transport 50 includes an endless perforated belt 57 surrounding a drive roller 53 and an idler roller 55 with a vacuum plenum positioned between runs of belt 57. The perforated belt forms a nip 58 with idler 56 in order to transport sheets back to the photoreceptor 6 by way of drive nips 32. If imaging on the second side of a sheet during a particular pass is not desirable, the sheet is fed through nip 43, 44 over the top of disc stacker 45 and guided by baffles 47 into nip 58 which drives the sheet into nip 32 for transport past photoreceptor 6. The vacuum-belt transport 50 can run at the same speed as the disc stacker 45 or it can run faster since a sheet can slip on the vacuum-belt transport until it is released by the disc stacker. Thus, inverter 40 provides a means for inverting a copy sheet and conveying it through an exit nip at the same or greater speed than it is received. Also, varying degrees of sheet overlap can be accommodated on the vacuum-belt transport which allows flexibility in controlling intercopy gap on the photoreceptor. The optional sheet invert or not invert feature of this inverter 40 is important, for example, in a 2-pass highlight color device where one would not invert for the second pass image on the first side. However, one would invert on the third pass for first color image on the second side, but not on the fourth pass for the second color image on the second side.

When the two-sided printing (copying) option is selected, a copy sheet 41 exiting the fuser 10 is diverted by gate 11 towards the inverter 40. The sheet is advanced between the feed rollers 43 and 44 into a finger 46 of the roller 45. The roller 45 starts turning in the clockwise direction of arrow 70 just before the paper reaches the end of the finger 46. It will be appreciated that the timing of the roller motion is not critical in this particular embodiment. The disc stacker 45 may start rotating when the leading edge of the paper is about ⅛" from the end of a finger 46 in that the function of the roller is to guide the sheet around its outside surface to vacuum transport 50. That is, the sheet 41 is not, and need not, be tightly would around the roller as shown in FIG. 2. Continued rotation of roller 45 brings a sheet 41 into the proximity of vacuum transport 50 where centrifugal force on the sheet and vacuum pressure from plenum 51 of vacuum transport 50 will cause sheet 41 to attach to belt 57 for transport in the direction of arrow 71 for capture by transport nips ]2 which convey the sheet back past photoreceptor 6 to have an image placed on the opposite side of the sheet with the sheet afterwards being stacked in output tray 18.

Fingered or slotted roller 45 can be formed, for example, from a soft rubber 48 directly onto a steel shaft 49 as shown in FIG. 2 or hard plastic, metal or it can comprise an array of slotted discs or other hollowed structure to reduce material amount and cost.

In conclusion, an inverter has been disclosed that uses a disc stacker adapted to capture a sheet and turn in a first direction in conjunction with a vacuum transport turning in the first direction, but moving the sheet in an opposite direction while being positioned to receive the sheet from the disc stacker and transport it turned over and trail edge first for further processing.

It is, therefore, evident that there has been provided in accordance with the present invention an inverter apparatus for copiers/printers or the like which serves to turn a sheet over and reverse lead and trail edges of the sheet thereby fully satisfying the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An inverter device, comprising:

a disc stacker rotatable in a predetermined direction and adapted to receive sheets lead edge first individually from a source, said disc stacker having members as a part thereof adapted to intercept and turn each sheet over individually when inversion is required;

a vacuum transport adapted to rotate in said predetermined direction while receiving each sheet individually from said disc stacker and feeding each sheet individually and trail edge first for further processing, and a controller for controlling the starting and stopping of said disc stacker and said vacuum transport, and wherein said controller is adapted to control the positioning of said members of said disc stacker to position them out of the path of an incoming sheet when inversion is not required and position them to intercept an incoming sheet when inversion is required.

2. The inverter device of claim 1, wherein said members as a part thereof are fingers.

3. The inverter device of claim 1, wherein said members as a part thereof are slots in said disc stacker.

4. The inverter device of claim 1, wherein said disc stacker and said vacuum transport are relatively located such that their outer surfaces move in opposite directions.

5. The inverter device of claim 1, wherein said vacuum transport is adapted to rotate in said predetermined direction at the same or greater speed than said disc stacker.

6. The inverter device of claim 1, wherein said vacuum transport is adapted to accommodate varying degrees of sheet overlap.

7. A machine capable of printing page image information onto both sides of a sheet by use of an inverter device, comprising:

a disc stacker rotatable in a predetermined direction and adapted to receive sheets lead edge first individually from a source, said disc stacker having members as a part thereof adapted to intercept and turn each sheet over individually when inversion is required;

a vacuum transport adapted to rotate in said predetermined direction while receiving each sheet individually from said disc stacker and feeding each sheet individually trail edge first for further processing, and a controller for controlling the starting and stopping of said disc stacker and said vacuum transport, and wherein said controller is adapted to control the positioning of said members of said disc stacker to position them out of the path of an incoming sheet when inversion is not required and position them to intercept an incoming sheet when inversion is required.

8. The copier/printer of claim 7, wherein said members as a part thereof are fingers.

9. The copier/printer of claim 7, wherein said members as a part thereof are slots in said disc stacker.

10. The copier/printer of claim 7, wherein said disc stacker and said vacuum transport are relatively located such that their outer surfaces move in opposite directions.

11. The copier/printer of claim 7, wherein said vacuum transport is adapted to rotate in said predetermined direction at the same or greater speed than said disc stacker.

12. The copier/printer of claim 7, wherein said vacuum transport is adapted to accommodate varying degrees of sheet overlap in order to provide flexibility in controlling intercopy gap between copy sheets.

13. In an imaging apparatus having an imaging station and capable of placing page image information onto copy sheets in single side or double side copying and including an inverter for inverting single sided copy sheets and forwarding the single sided copy sheets to the imaging station for receipt of second side page image information on the opposite side thereof, the improvement of the inverter, comprising: a roll member rotatable in a predetermined direction and adapted to receive copy sheets lead edge first individually from the imaging station, said roll member having copy sheet arresting members as a part thereof adapted to intercept and turn each copy sheet over individually when double sided imaging is required; a vacuum transport adapted to rotate in said predetermined direction while receiving copy each sheets individually from said roll member and feeding each copy sheet individually trail edge first toward the imaging station for further processing; and a controller adapted to position said roll member such that copy sheets are inverted or not inverted by said roll member depending on imaging requirements.

14. The improvement of claim 13, wherein said controller is adapted to position said roll member to not intercept a second pass of individual copy sheets fed thereover when 2-pass highlight color is being practiced.

* * * * *